US008282785B2

(12) United States Patent
Ajoviita

(10) Patent No.: US 8,282,785 B2
(45) Date of Patent: Oct. 9, 2012

(54) ROLL COVER AND A COVERED ROLL

(75) Inventor: Tommi Ajoviita, Tikkakoski (FI)

(73) Assignee: Metso Paper, Inc., Helsinki (FI)

( * ) Notice: Subject to any disclaimer, the term of this patent is extended or adjusted under 35 U.S.C. 154(b) by 334 days.

(21) Appl. No.: 12/450,040

(22) PCT Filed: Mar. 20, 2008

(86) PCT No.: PCT/EP2008/053388

§ 371 (c)(1),
(2), (4) Date: Jan. 25, 2010

(87) PCT Pub. No.: WO2008/116832

PCT Pub. Date: Oct. 2, 2008

(65) Prior Publication Data

US 2010/0132904 A1 Jun. 3, 2010

(30) Foreign Application Priority Data

Mar. 23, 2007 (FI) ..... 20070244

(51) Int. Cl.
*D21F 3/08* (2006.01)
*D21G 1/02* (2006.01)

(52) U.S. Cl. ..... 162/361; 162/358.1; 492/20; 492/48; 100/155 R; 100/160

(58) Field of Classification Search ..... 162/205, 162/206, 358.1, 358.2, 358.3, 358.4, 361, 162/362; 492/20, 48; 100/155 R, 160
See application file for complete search history.

(56) References Cited

U.S. PATENT DOCUMENTS

| | | | | |
|---|---|---|---|---|
| 4,368,568 | A * | 1/1983 | Watanabe | 492/52 |
| 6,375,602 | B1 * | 4/2002 | Jones | 492/50 |
| 6,379,290 | B1 * | 4/2002 | Sohl | 492/56 |
| 2006/0054032 | A1 * | 3/2006 | Rheims et al. | 100/35 |

FOREIGN PATENT DOCUMENTS

| | | | |
|---|---|---|---|
| EP | 1 041 197 | A1 | 10/2000 |
| EP | 1 041 198 | A1 | 10/2000 |
| EP | 1 055 028 | B1 | 5/2002 |
| EP | 1422341 | * | 5/2004 |
| JP | 05-280531 | * | 10/1993 |
| WO | WO 98/00438 | A1 | 1/1998 |

* cited by examiner

*Primary Examiner* — Eric Hug
(74) *Attorney, Agent, or Firm* — Oliff & Berridge, PLC

(57) ABSTRACT

Invention relates to a roll cover and a covered roll for paper, board, finishing and tissue machines. More specifically it relates to a roll particularly used in calendar which roll comprises a metal roll body and a cover of a composite material on it. The cover has at least three layers which comprise polymer matrix and fiber reinforcement the material of the being different at least in successive layers.

18 Claims, 3 Drawing Sheets

ROLL COVER AND A COVERED ROLL

TECHNICAL FIELD

The object of the invention is a roll cover and a covered roll for paper, board, finishing or tissue machines. More specifically, the object of the invention is a roll to be used especially in a calender, the roll comprising a composite cover on a metal shell which cover comprises elastic polymer and fibre reinforcement.

PRIOR ART

In paper industry polymer covered rolls are widely used today in many different positions. As examples of these rolls can be mentioned press rolls, suction rolls and especially calender rolls in multiroll and soft nip calenders. The role of the cover is very crucial particularly in calender rolls, since in calenders the paper web is led unsupported to a nip which is formed between a polymer covered roll and a hard-faced counter roll, ie. in the nip the web is in direct contact with the roll surface. Thus the roll cover has a great influence not only on gloss, smoothness and other surface properties of the finished paper product but also on paper bulk. The size of the rolls is 6-12 m length, diameter 600-1500 mm. The magnitude of linear loads in these rolls is 300-600 N/mm and surface pressure 50 N/mm$^2$.

Specifically, the object of the invention is a composite cover for multiroll and soft calender rolls with very demanding requirements with respect to linear load, operation speed, thermal durability and combinations thereof and at the same time to improve the quality level of the paper.

In general, there is a difference in stiffness of a polymeric cover and a metallic roll body, which under loaded state causes shear stress on metal-polymer interface. This stress is tried to minimize by covers having several layers of different stiffness properties. Most often, the polymer cover is two-layered comprising a bottom layer on the metal body and a functional layer on the bottom layer, the stiffness of the bottom layer being lower than that of the metal body but higher than stiffness of the functional layer.

This kind of cover is described for example in document EP 1055028 relating to a soft calender and a polymer (polyurethane) covered roll used in it. Polymer covers comprising more than two layers are also described, the hardness of the layers being varied stepwise as was the stiffness of the two-layered cover mentioned earlier so that hardness of the cover is radially decreased towards the top. The cover of EP 1055028 may comprise glass fiber or other very hard composite between the polymer cover and metal body.

Also known in the prior art are composite covers with several layers of reinforcement, the amount or quality of the reinforcement being different in different layers. Such covers are disclosed for example in the following documents: U.S. Pat. No. 4,368,568, EP 1041197, EP 1041198, WO 9800438.

In U.S. Pat. No. 4,368,568 a roll cover on a metal roll body is disclosed having an outermost layer of polyurethane rubber. Under the polyurethane rubber surface layer several reinforcement layers are provided, the innermost of which being epoxy impregnated glass fiber cloth, on that a layer of polyester or non-woven rayon fiber impregnated with epoxy and glass balls is provided and on the surface a layer of polyurethane rubber is provided. An improved cover peeling/delamination resistance was achieved with the cover.

EP 1041197 discloses a cover with composite structure having several layers of fiber reinforcement. Orientation of the fibers in successive layers is different.

EP 1041198 B1 discloses a roll cover with composite structure having a radially varying, preferable decreasing fiber content from bottom to top. Decrease of the fiber content may occur continuously or stepwise. With the fiber content also the coefficient of thermal expansion is varying in radial direction. Thus it is possible to adjust thermal expansion coefficient of the radially innermost area by using relatively high fiber content to achieve a coefficient of thermal expansion which is substantially the same or of the same level as that of the roll body. During operation when the temperature of the roll will increase the innermost area of the cover will expand substantially as much as the roll body, thus the high axial longitudinal stresses between roll body and the cover can be prevented.

WO 9800438 discloses a composite cover with a thermoplastic matrix material. By the use of thermoplastic the thermal durability of the cover is tried to be improved. Several reinforcement layers are used and they are alternating with unreinforced layers.

All the documents above aim to a cover durable heavy conditions of a calender environment. During the very recent years the conditions have become even heavier than earlier. Operating speed requirements have constantly increased, the design speeds of paper machines today being more than 2000 m/min up to 3000 m/min. This is the reason why the cover is exposed not only to a faster mechanical load cycle but also a higher temperature than earlier since in online calenders the paper web running with such a high speed brings a bigger and bigger thermal load to the nip. The covers of today are not able to fulfill these requirements.

DESCRIPTION OF THE INVENTION

Purpose of the invention is to overcome problems occurring in prior art and provide a cover for calender rolls that is more durable and has better performance than current covers.

The cover of the invention has several layers comprising of fiber reinforcement and polymer matrix, the fiber reinforcement material being different at least in successive layers. Fiber material is selected such that coefficient of thermal expansion of the fibers of each layer is increased in radial direction from the roll body towards the top.

One preferred embodiment of the invention is a roll cover having at least three layers comprising of fiber reinforcement and polymer matrix, the fiber reinforcement material being different at least in successive layers and the intermediate layer sandwiched between a bottom layer and a top layer comprising mainly of carbon fiber.

Another preferred embodiment of the invention is a roll cover having at least three layers comprising of fiber reinforcement and polymer matrix: the first or bottom layer on the roll body; the second or intermediate layer on the bottom layer comprising of a fiber material which is different from fiber material of the bottom layer and comprising mainly carbon fiber; a third or a shift layer on the intermediate layer, comprising at least two different fiber material one of which being carbon fiber; and a fourth or a top layer on the shift layer, providing a functional outer surface and comprising mainly of a fiber material that is different from the fiber material of the intermediate layer.

The fiber material in the invention may comprise inorganic, organic, natural and synthetic fibers. Inorganic fibers applicable in the invention are for example glass or boron fibers. Organic fibers applicable in the invention are for example polyacrylonitriles, polyamides, aromatic polyamides and carbon fiber. Type of the fiber can be woven, non-woven or roving fiber.

The roll of the invention gives an improved thermal conductivity and uniform thermal distribution inside the cover.

DETAILED DESCRIPTION OF THE INVENTION

The invention is described with the aid of FIGS. 1-3, in which

Figure 1:
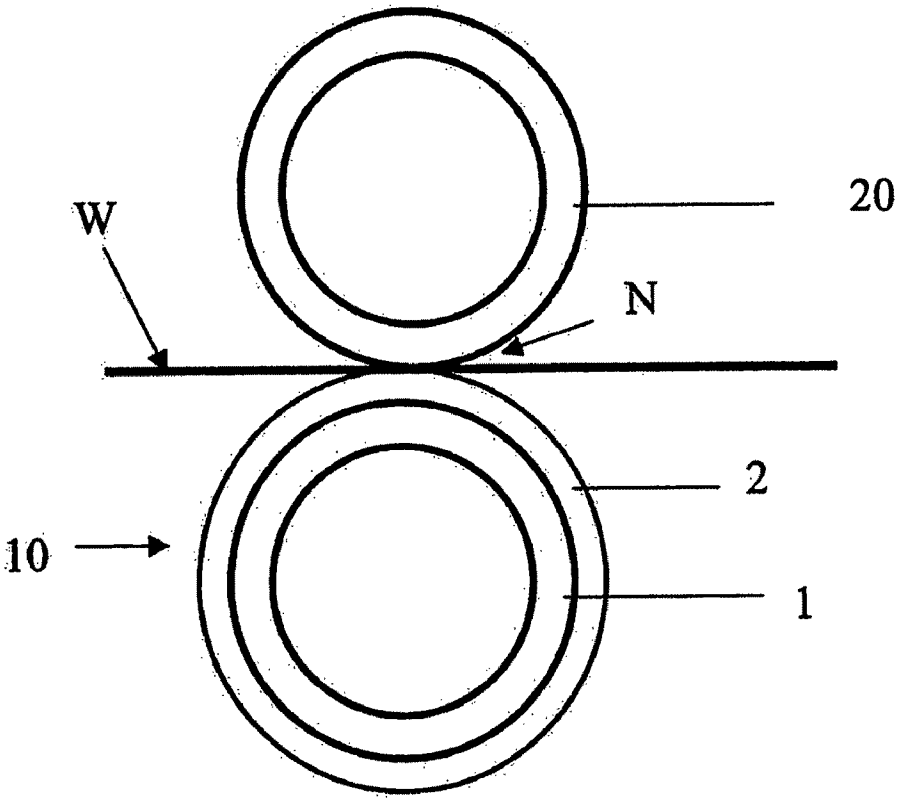
FIG. 1 shows a covered roll of the invention in a soft calender

FIG. 1 shows a calender having two rolls 10 and 20 in mutual nip contact. Paper web W is led to the nip N between the rolls. The roll 10 of the invention comprises a metal body 1 and a composite cover 2 on the body. The cover is disclosed more closely in FIG. 2. Counter roll 20 is a hard faced roll which can be heated.

Figure 2:
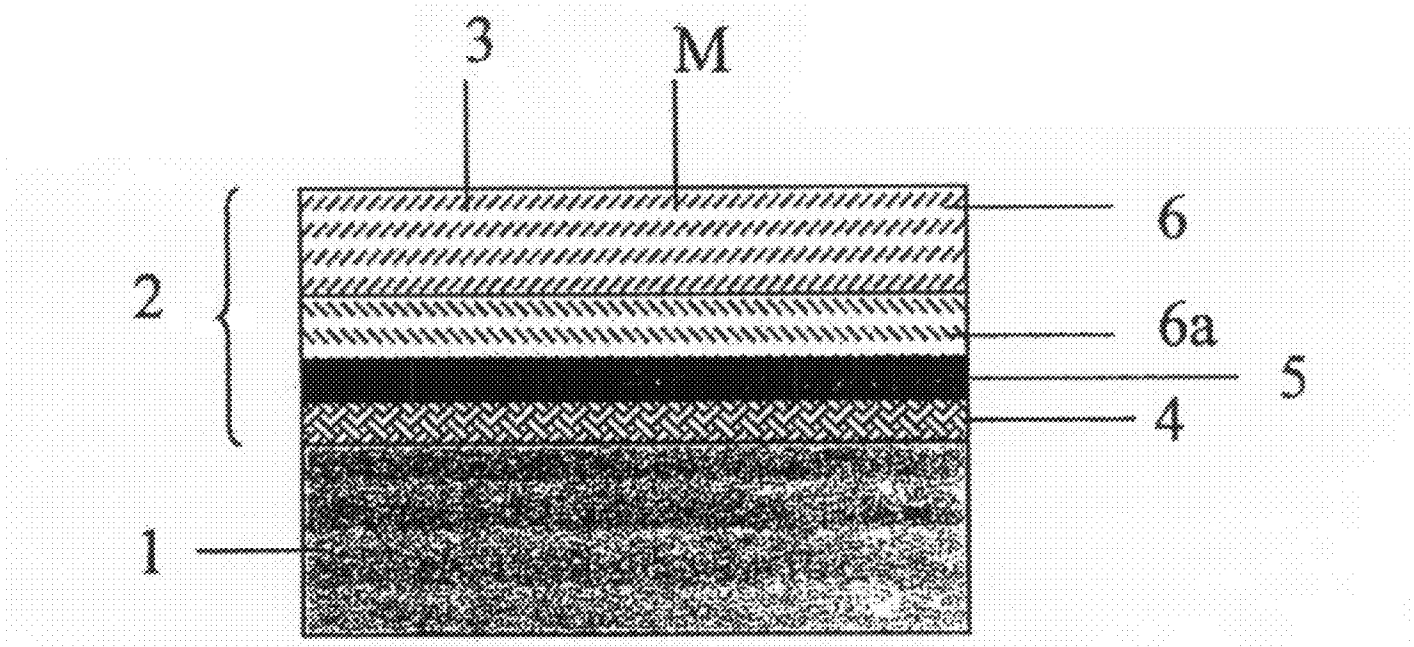
FIG. 2 shows a cross section of the cover of the invention

FIG. 2 shows more closely cover 2 of the invention which is applied on a roll body 1. Cover 2 comprises several layers comprising reinforcing fiber 3 and polymer matrix M. For the sake of simplicity the matrix M and embedded fiber 3 is disclosed in the Figure only in connection with the outermost layer, but it is to be understood that each layer 4 to 6 comprises both fiber 3 and matrix M. polymer matrix M may be thermoset or thermoplastic material, preferably a system comprising thermoset resin and a hardener. Examples are epoxy, polyester, polyurethane and rubber. Typical matrix is epoxy. Fiber content of the layers is typically from 5 to 90% of the volume of the layer. Layer that is located more closely to the roll body 1 the fiber content is from 50 to 90%, the amount of fiber can be less near the surface.

Roll cover 2 of the invention comprises at least the following layers:

a) bottom layer 4 b) intermediate layer 5 c) top layer 6

Bottom layer 4 is applied on the roll body 1. Roll body 1 is metallic, such as cast iron or steel. Bottom layer 4 comprises fiber reinforcement 3 for example glass fiber. Preferably it is a glass fiber cloth which is woven of a long (continuous) glass fiber since woven structure gives better two-dimensional stiffness thus improving delamination resistance from the metal surface. Bottom layer 4 is manufactured by impregnating a fiber cloth, preferably a woven glass fiber cloth, with a polymer resin M and winding it around roll body 1 in one or more layers until a desired layer thickness is achieved, which is 2-20 mm for the bottom layer, more preferably 3-15 mm, most preferably 3-10 mm.

Intermediate layer 5 is manufactured over the bottom layer 4. Layer 5 comprises matrix M and fiber material Fiber material of the intermediate layer 5 comprises mainly of carbon fiber. Carbon fiber content of total fibers in the intermediate layer is such that in the layer the carbon fibers are in contact with each other to be able to create a carbon fiber network. In its minimum the carbon fiber content should be at least 25% of the total fiber in the intermediate layer 5, preferably more than about 50%, more preferably 80-100%, most preferably 90-100%, the residual fiber being for example glass fiber. The more the content of carbon fiber in the layer 5 is the better is its thermal conductivity. 25% carbon fiber content, although it works, is still less advantageous than content of about 50% or more. Layer 5 is made by winding over the bottom layer 4 a continuous carbon fiber or preferably non-woven carbon fiber felt or mat as one layer or more layers until a desired layer thickness is achieved which in case of intermediate layer is 1 or less to 10 mm, more preferably about 1-6 mm. Non-woven carbon fiber is more advantageous than continuous fiber in terms of both thermal conductivity and heat distribution. Non-woven carbon fiber felt or mat comprises chopped fibers or short fibers which are bound together with a binder agent or mechanically by needling. Because of the small length of the fibers stiffness of the non woven material is lower than stiffness of a continuous fiber material and also lower than stiffness of the woven glass fiber cloth used in the bottom layer 4. Stepped stiffness variation is recommended, because risk of delamination at the boundary surface of the layers is thus decreased. Non woven chopped fiber is found to be preferable also for sake of thermal conductivity and heat distribution which is discussed more closely later. Between the bottom layer 4 and the intermediate layer 5 a winded layer (not shown) of glass or carbon roving fiber may be provided.

Top layer 6 forms the outermost or functional layer of the roll and it comes into contact with paper W or, in case of press section, with a fabric supporting the paper W. In the preferred embodiment in a calender application the top layer 6 is in contact with the paper and has a great influence to surface properties of the paper W. Fiber material of top layer 6 is preferably synthetic organic fiber polymer, especially aliphatic or aromatic polyamide, more preferably aramide fiber such as fiber known by a trade name Kevlar. It is the superior wear resistance and especially impact strength properties that makes use of aramide fiber preferred just here in top layer. Further, it has good vibration absorbing properties. Good thermal resistance and excellent dimensional stability even in high temperatures are desired properties of the fibers. Layer 6 is made by winding a continuous aramide fiber or preferably non-woven aramide felt or mat over the layer 5, 5*a* as one layer or as several layers until a desired layer thickness is achieved which in case of top layer is 5-15 mm, more preferably 6-10 mm. Like in case of intermediate layer 5 also in case of top layer 6 it is more preferable to use non woven aramide fiber than continuous fiber because of stepped stiffness shift, more uniform surface properties and thermal conductivity. The fiber material of top layer 6 comprises merely or mainly of aramide fiber. In a very preferred case fiber material of the top layer 6 comprises both aramide fiber and carbon fiber, content of aramide fiber being more than 50% of the total fiber, more preferably from 80 to 100%. In the presence of carbon fiber thermal conductivity of the top layer is even better.

In one preferred embodiment of the invention there is at least one additional layer or a so called transitional layer between top layer 6 and intermediate layer 5 which is marked by a reference number 6*a* in FIG. 1. Transitional layer 6*a* comprises as fiber material a mixture of fiber materials of the intermediate layer 5 and the top layer 6, the latter being preferably aramide. A preferred mixture ratio for the fibers of layer 6*a* is for example 20-80% of carbon and 80-20% of fiber of layer 6 such as aramide, for example carbon to aramide ratio being 50:50. Carbon fiber content of layer 6*a* preferably decreases and aramide fiber content increases in radial direction towards the top surface. Total fiber content remains however the same over the radial thickness of the whole layer. The layer 6*a* is optional but preferred because due to carbon fibers heat is transferred better from the surface towards intermediate layer 5 and also due to gradual decrease of stiffness between the intermediate layer and the top layer.

The cover of the present invention may contain fillers. With the fillers properties of the cover can be improved or its cost can be cut. Typically, fillers are used to improve wear resistance and to adjust matrix stiffness and hardness. Fillers applicable in the invention are inorganic fillers, such as metal, ceramic and mineral fillers, for example aluminium oxide, silicon oxide, carbides, nitrides, glass, silicates and mica in many different particle forms like powder, balls, pearls, fibers etc., and synthetic organic fillers, such as synthetic polymers for example UHMWPE, synthetic fibers such as short fibers, chopped fibers, powdered fibers, aliphatic or aromatic polyamide as an example. Fillers are generally applied to the composition as a mixture with resin material. Fillers can be used in each layer of the cover.

The cover of the invention may also contain other additives and process aid agents such as polymerization initiators, activators and accelerators, hardeners, plasticizers, thermal stabilators, antioxidants, antiozonates, pigments etc. for promoting the process and improving physical properties of the cover. These agents are mixed with the matrix before bringing into contact with the fiber material.

EXAMPLES

Example 1

On a steel roll body of a nip simulator device, length 20 cm, diameter 20 cm, was manufactured a cover of the invention in which:

a) the bottom layer was manufactured on the steel body of the roll by winding a woven glass fiber cloth impregnated with epoxy resin
b) the intermediate layer was manufactured on the bottom layer by winding a carbon fiber felt impregnated with epoxy resin
c) the top layer was manufactured on the intermediate layer by winding a para-amide felt impregnated with epoxy resin
d) curing the cover thus made in a temperature of about 160° C.

COMPARATIVE EXAMPLE

The cover of the comparative example was manufactured as in Example 1 except phase b) so without carbon fiber intermediate layer.

In testing of the covers a nip simulator was used which comprises two rolls having length of 20 cm and diameter of 20 cm in nip contact with each other, maximum linear load being 400-600 kN/m. One of the rolls was hard faced metal roll and the other roll could be covered with a desired polymer material. Both rolls were thermally adjustable. In the tests, the other roll was covered with a cover of the invention and then with a cover of a comparative example.

The rolls were rotated by an electric motor with rotational speeds of 800, 1200 and 1400 rpm. Durability of the covers was determined for different linear loads until visual indications of damage was seen or, most often, a local overheating (so called hot spot) was measured which is known to cause a cover damage in a very short term or in case of increased load. Temperature of the cover was monitored during the test to discover the hot spots.

Figure 3:
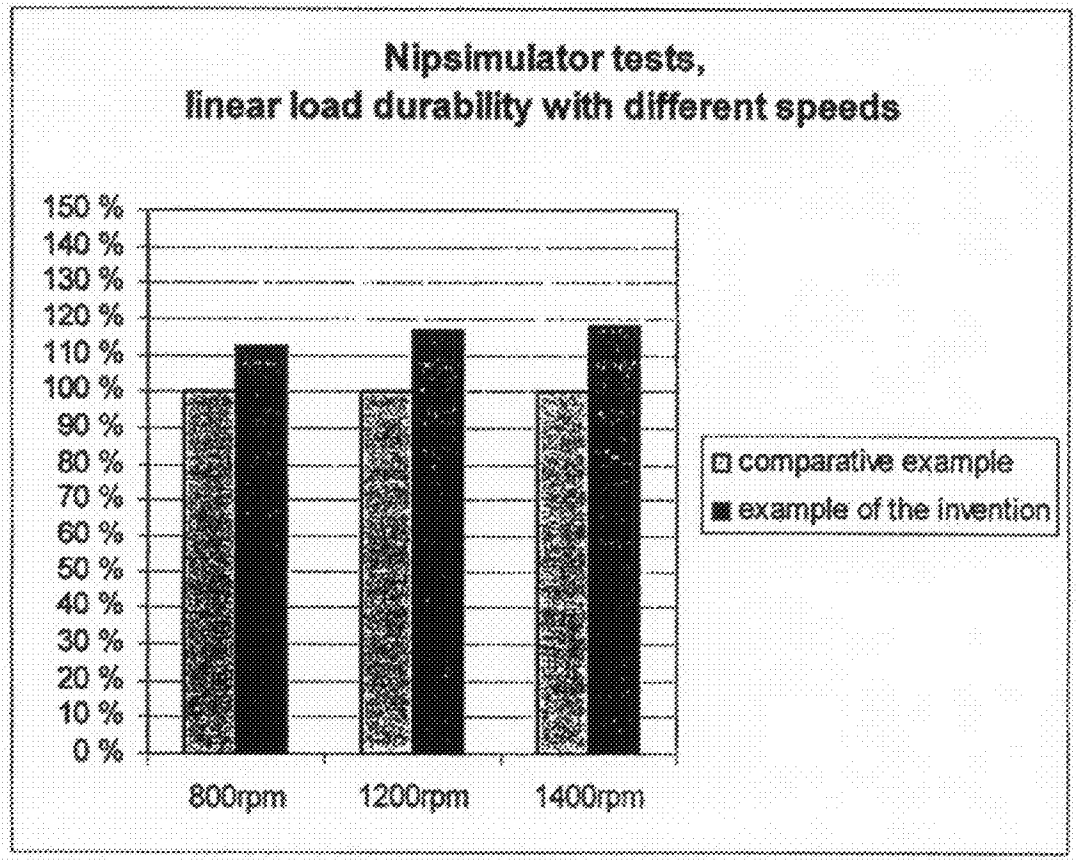
FIG. 3 shows graphically performance test results of a prior art cover and the cover of the invention.

The results are given in FIG. 3. Linear load durability with different speed levels are given relatively so that durability of the comparative cover was 100% and durability performance of the cover of the invention was compared to that. As can be seen from the results, performance of the cover of the invention or its ability to resist high loads is clearly better than that of the comparative cover with each rotational speed level that was used. Linear loads were 10-20% higher in case of the cover of the invention than in case of the prior art cover.

It is not fully clear which is the reason why carbon fiber intermediate layer improves linear load durability but it may come along with good thermal conductivity of the carbon fiber on the other hand and lower differential stiffness inside the cover on the other hand. In temperature measurements it was detected that covers with carbon fiber intermediate layer had a more uniform temperature distribution over the whole cover area than the comparative cover. Under mechanical load strain centers occur in the cover not only on the roll body-cover interface but also on internal interfaces of the layers. Heat centers are believed to occur at layer interfaces as well which makes that heat cannot easily discharge over a wider area. The carbon intermediate layer is believed to be helpful for both problems. Especially use of short carbon fibers in non woven intermediate layer is preferable. Felt-type intermediate layer has a lower stiffness than the woven glass fiber layer beneath it but it is higher than stiffness of the aramide felt. Fiber orientation in the felt is random which promotes heat to conduct and spread to a wider area. Risk of local over heated centers is thus reduced.

Certain properties of glass, carbon and aramide fibers are presented in the following table 1.

| | E Glass | Carbon fiber | Kevlar |
|---|---|---|---|
| Thermal conductivity, W/mK | 1 | 10-100 | 0.04 |
| Thermal expansion, $10^{-6}$ l/K | 5 | | |
| in axial direction of the fiber | | 0--1.5 | −2 |
| in cross-sectional direction | | 25-37 | 59 |
| Module of stiffness, $10^{6}$ psi | 10.5 | 32 | 16.3 |
| Tensile strength, $10^{-3}$ psi | 500 | 450 | 424-435 |

Selecting of both the fiber material and the fiber type according to invention improves durability of the cover as shown experimentally above. It is to be noted that in the invention it is not only one physical property such as mere stiffness or mere thermal resistance that is tried to optimize with a risk to loose other essential properties that are crucial for roll behaviour in operation and quality of the paper. The invention surprisingly shows that carbon fiber when located only in the middle of the cover structure improves performance of the cover.

The invention claimed is:

1. Roll for a calender comprising a cylindrical roll body of metal material and on said body an elastic cover which cover comprises at least three layers comprising polymer matrix and fiber reinforcements, wherein the cover comprises at least three layers of which fiber material of the middle or the intermediate layer includes at least 25% of carbon fiber.

2. Roll of claim 1, wherein the carbon fiber is in the form of non-woven fiber.

3. Roll of claim 1, wherein the thickness of the intermediate layer is less than thickness of the layers between which it is sandwiched.

4. Roll of claim 1, wherein the innermost layer or the bottom layer comprises glass fiber.

5. Roll of claim 4, wherein the bottom layer comprises woven glass fiber.

6. Roll of claim 1, wherein the outermost layer or the top layer comprises 50-100% of synthetic polymer fiber.

7. Roll of claim 6, wherein the residual fiber, if any, of the top layer is carbon fiber.

8. Roll of claim 6, wherein the synthetic polymer fiber of the top layer is aramide fiber in the form of non-woven fiber.

9. Roll of claim 1, wherein the cover comprises a transition layer between top layer and intermediate layer.

10. Roll of claim 9, wherein the transition layer comprises carbon fiber and another fiber that is the same fiber material as used in top layer.

11. Roll of claim 9, wherein the transition layer comprises carbon fiber and aramide fiber.

12. Roll of claim 9, wherein the transition layer comprises carbon fiber and another fiber in ratio of 20:80-80:20.

13. Roll of claim 9, wherein relative content of carbon fiber decreases in the transition layer in radial direction towards the top layer.

14. Roll of claim 1, wherein the polymer of the matrix is epoxy, polyester, polyurethane or rubber or any thermoset or thermoplastic polymer.

15. Roll of claim 1, wherein the cover comprises fillers.

16. Calender for web fiber machine comprising at least two rolls and mutual nip between the rolls to which nip the web can be lead, one of the rolls being hard faced roll and the other roll has an elastic cover wherein the roll is the roll of claim 1.

17. Roll for a calender comprising roll body of metal material and on said body an elastic cover circumferentially covering the outer surface of the roll body, the cover comprising at least three layers comprising polymer matrix and fiber reinforcements, wherein the cover comprises at least three layers of which fiber material of the middle or the intermediate layer includes at least 25% of carbon fiber.

18. Roll for a calender comprising roll body of metal material and on said body an elastic cover having an interface with the metal material of the roll body, the cover comprising at least three layers comprising polymer matrix and fiber reinforcements, wherein the cover comprises at least three layers of which fiber material of the middle or the intermediate layer includes at least 25% of carbon fiber.

* * * * *